United States Patent [19]

Sohn

[11] 4,383,643

[45] May 17, 1983

[54] BOILER TANK FOR EFFICIENTLY CIRCULATING LOW-TEMPERATURE WATER

[76] Inventor: Lan S. Sohn, 4-1, Mok-dong, Gangso-Ku, Seoul, Rep. of Korea

[21] Appl. No.: 276,025

[22] Filed: Jun. 22, 1981

[30] Foreign Application Priority Data

Oct. 15, 1980 [KR] Rep. of Korea ..... 6573[U]

[51] Int. Cl.[3] ..... F16T 1/06

[52] U.S. Cl. ..... 237/60; 237/64; 237/66; 417/209; 165/104.28

[58] Field of Search ..... 237/19, 60, 61, 64, 237/66; 122/37, 83, 123; 417/207, 208, 209; 165/104.28

[56] References Cited

U.S. PATENT DOCUMENTS

| | | | |
|---|---|---|---|
| 667,377 | 2/1901 | Waterhouse | 417/208 |
| 2,170,225 | 8/1939 | Unge | 237/60 |
| 3,073,257 | 1/1963 | MacCracken | 417/209 |
| 4,016,384 | 4/1977 | Jensen | 237/60 X |
| 4,242,569 | 12/1980 | Kayser | 237/19 |

FOREIGN PATENT DOCUMENTS

| | | | |
|---|---|---|---|
| 384716 | 2/1907 | France | 237/64 |

*Primary Examiner*—Albert W. Davis, Jr.
*Attorney, Agent, or Firm*—Phillips, Moore, Lempio & Finley

[57] ABSTRACT

A boiler tank (1) for a hot-water heating system comprises first (2) and second (7) partitions, defining first (4), second (9), and third (10) chambers. Inlet (6) and outlet (6') pipes communicate with the second chamber, a transfer conduit (3) intercommunicates the first and second chambers, and an opening (8) intercommunicates the second and third chambers.

5 Claims, 1 Drawing Figure

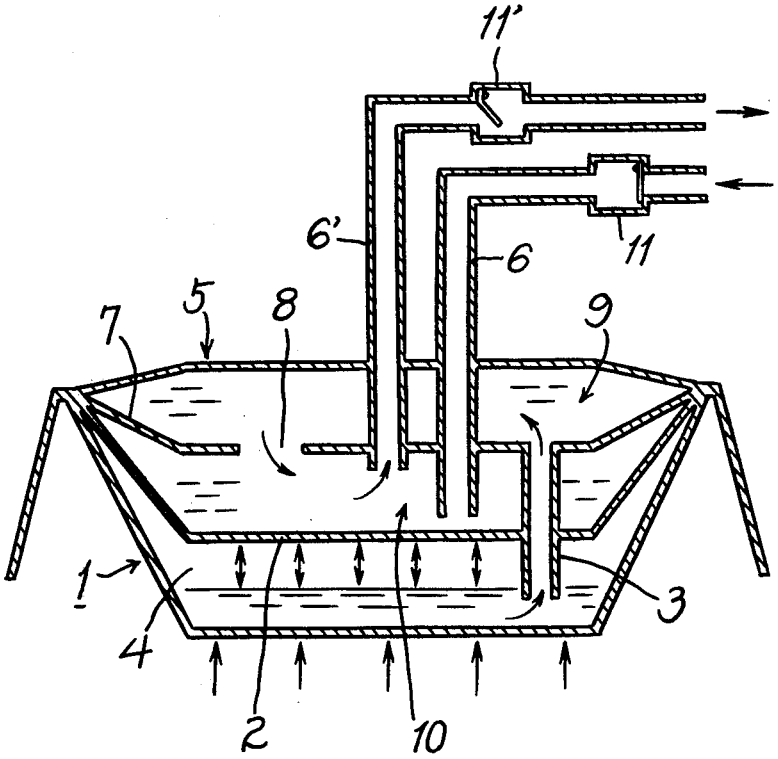
11'
6'
6
11
5
8
7
9
1
4
3
2
10

BOILER TANK FOR EFFICIENTLY CIRCULATING LOW-TEMPERATURE WATER

DESCRIPTION

1. Technical Field

This invention relates generally to a hot water heating system and more particularly to a boiler employed in such system for efficiently inducing continuous circulation of low-temperature water therein.

2. Background Art

Hot water heating systems, either of the gravity or pump circulation type, include a boiler for heating water which is circulated through radiators. The boiler includes an expansion tank, the design of which is based on the total volume of system water, the hydrostatic head of the tank, the pumping head of the tank, and the water-temperature range over which the system operates. Many such tanks are partitioned to define an upper chamber connected to an outlet pipe for communicating the heated water to the radiators and a lower or expansion chamber which is heated to vaporize the water therein to pressurize the system to induce circulation therein.

Boiler tanks of this type require that the temperature of the water in both chambers be in the range of 100° C. to ensure circulation of the water. Thus, the raising of the water temperature to this relatively high temperature range requires a prolonged time period which delays efficient circulation of the water through the radiators and also results in substantial heat losses.

DISCLOSURE OF INVENTION

An object of this invention is to provide an energy-efficient boiler tank for circulating low-temperature water through a hot-water heating system. The boiler tank comprises a first partition defining a first chamber adapted to be heated to vaporize water therein, a second partition defining a second chamber and further defining a third chamber between the first and second chambers, inlet and outlet pipes communicating with the second chamber, first means for intercommunicating the first and second chambers, and second means for intercommunicating the second and third chambers.

BRIEF DESCRIPTION OF THE DRAWING

The drawing is a cross-sectional view through a boiler tank embodying this invention.

BEST MODE OF CARRYING OUT THE INVENTION

The drawing illustrates a boiler tank 1 for use in a hot-water heating system to circulate heated water through radiators (not shown). As will be appreciated by those skilled in the art, boiler tank 1 is adapted to efficiently circulate relatively low temperature water (e.g., 60°–80° C.) and to prevent undue heat losses. In contrast thereto, and as discussed above, conventional hot water heating systems require that the water attain a temperature in the range of 100° C. for circulation purposes which not only requires substantial time periods to raise the temperature of the water to such temperature levels, but also results in substantial heat losses.

Boiler tank 1 comprises a first or lower partition 2, having a hereinafter described transfer conduit 3 extending therethrough, to define a first or heated expansion chamber 4 in the boiler tank. As schematically illustrated by the arrows below chamber 4, the chamber is adapted to be heated in a conventional manner to boil the water and create a vapor pressure therein for purposes hereinafter described. The boiler tank further comprises an upper tank portion 5 having standard inlet and outlet pipes 6 and 6', respectively, connected thereto, as shown. The upper tank portion further comprises a second partition 7, having an opening 8 formed therethrough, which defines a second chamber 9 and further defines a third chamber 10 between the first and second chambers.

The inlet and outlet pipes are positioned laterally between transfer conduit 3 and opening 8 and communicate with second chamber 10 with the outlet from inlet pipe 6 extending below the inlet to outlet pipe 6' and in close proximity to partition 2. A pair of standard one-way check valves 11 and 11' are mounted in inlet and outlet pipes 6 and 6', respectively, to function in a conventional manner. In the drawing, check valve 11 is shown in its closed position, whereas check valve 11' is shown in its open position for circulating heated water to the radiators (not shown).

In operation, the water is heated in chamber 4 to create a vapor pressure therein, as indicated by the double-arrows in the drawing. The heated water will then sequentially circulate through transfer conduit 3, chamber 9, opening 8, and through outlet pipe 6', connected to the radiators. Thus, transfer conduit 3 functions as first means for intercommunicating first chamber 4 with second chamber 9 and opening 8 functions as second means for intercommunicating second chamber 9 with third chamber 10.

When the water level in chamber 4 drops below the inlet to transfer conduit 3, the vapor pressure in chamber 4 will decrease to aid in inducing the relatively cool water in inlet pipe 6 to be drawn into chamber 10. Such cool water will impinge upon partition 2 to aid in condensing the water vapor in chamber 4 to induce circulation of the relatively cool water into the chamber via transfer conduit 3. The further cooling of the vapors in chamber 4 will aid in creating a negative pressure in the system for inducing water flow from inlet pipe 6 and into chamber 10.

Thus, boiler tank 1 will ensure rapid and efficient circulation of the heated water through the hot water heating system to provide efficient heating and a reduction in heat losses over conventional systems of this type.

I claim:

1. In a hot-water heating system, a boiler tank (1) comprising a first partition (2) defining a first chamber (4) adapted to be heated to vaporize water therein, a second partition (7) defining a second chamber (9) and further defining a third chamber (10) between said first and second chambers, inlet (6) and outlet (6') pipes each communicating with said second chamber, first means (3) for intercommunicating said first and second chambers, and second means (8) for intercommunicating said second and third chambers.

2. The hot-water heating system of claim 1 wherein each of said inlet and outlet pipes has a one-way check valve (11,11') therein.

3. The hot-water heating system of claim 1 wherein an outlet of said inlet pipe is positioned vertically below an inlet of said outlet pipe and is further positioned in close proximity to said first partition.

4. The hot-water heating system of claim 1 wherein said first means comprises a transfer conduit secured between said first and second partitions.

5. The hot-water heating system of claim 4 wherein said second means comprises an opening formed through said second partition and wherein said inlet and outlet pipes are positioned laterally between said transfer conduit and said opening.

* * * * *